United States Patent [19]

Roddier

[11] 4,238,044

[45] Dec. 9, 1980

[54] COLLAPSIBLE PLASTIC CRATE FOR DISPLAY AND TRANSPORT OF PERISHABLE COMMODITIES

[76] Inventor: Roger Roddier, Impasse du Breuil, Thiers, France

[21] Appl. No.: 223,447

[22] Filed: Feb. 4, 1972

[30] Foreign Application Priority Data

Dec. 10, 1970 [FR] France ..... 70.45693
Jul. 13, 1971 [FR] France ..... 71.26421

[51] Int. Cl.[3] ..... B65D 6/24
[52] U.S. Cl. ..... 220/4 F; 220/72
[58] Field of Search ..... 220/4 F, 72, 30; 229/30; 217/26.5

[56] References Cited

U.S. PATENT DOCUMENTS

| | | | |
|---|---|---|---|
| 1,656,497 | 1/1928 | Paulson | 220/4 F |
| 2,549,013 | 4/1951 | Robles | 220/4 F |
| 2,862,640 | 12/1958 | Somavia | 220/4 F |
| 2,964,210 | 12/1960 | Paley | 220/4 F |
| 3,081,897 | 3/1963 | Livingston | 220/4 F |
| 3,306,484 | 2/1967 | Padovani | 217/26.5 |
| 3,360,180 | 12/1967 | Venturi | 229/30 |
| 3,497,127 | 2/1970 | Box | 229/30 |

FOREIGN PATENT DOCUMENTS

| | | | |
|---|---|---|---|
| 1341528 | 7/1962 | France | 220/4 F |
| 1291279 | 3/1969 | France | 229/30 |
| 1134859 | 11/1968 | United Kingdom | 229/30 |

*Primary Examiner*—George E. Lowrance
*Attorney, Agent, or Firm*—Haseltine, Lake & WatersLake

[57] ABSTRACT

A collapsible crate is formed by separate long side wall members, short side wall members and a bottom member. The members are made of lightweight plastic material and include respective tongues and slots for interfitting the members to assemble same without need for a tool. The members are of lattice construction and have strips with flat inner surfaces.

10 Claims, 10 Drawing Figures

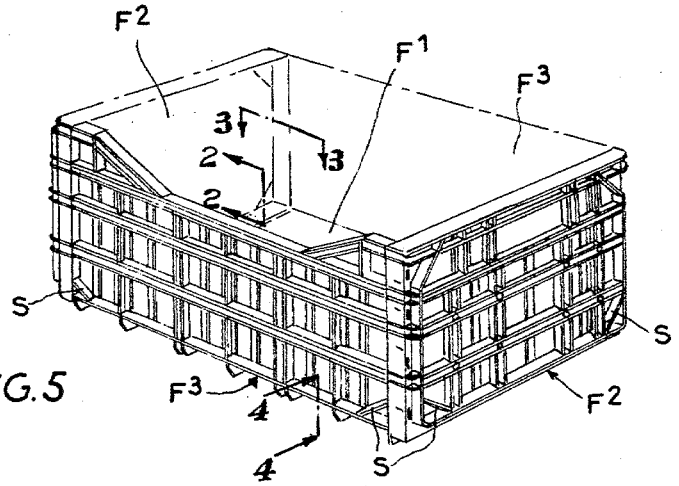
FIG. 5
FIG. 6
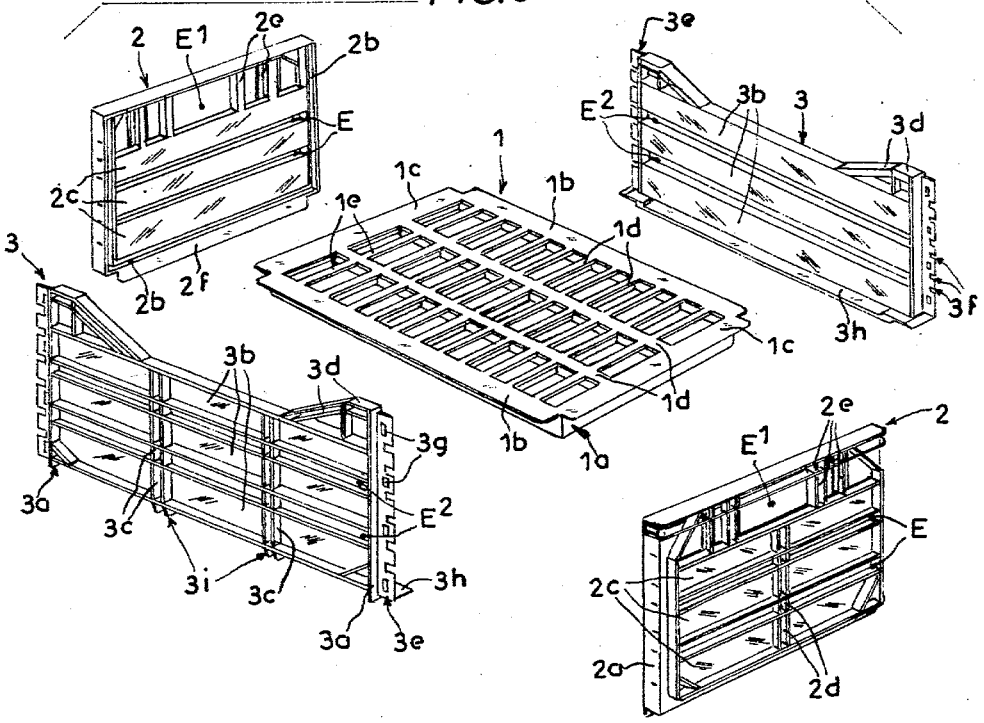

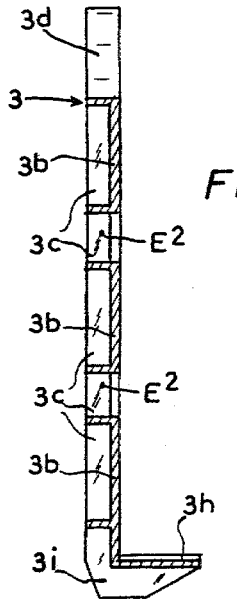
FIG.7
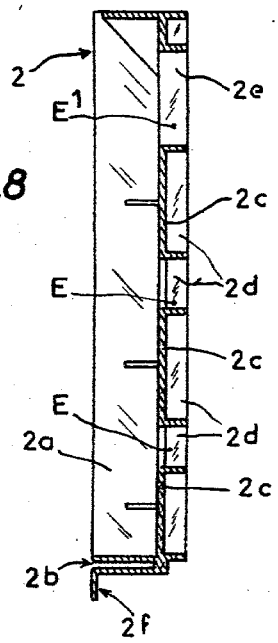
FIG.8
FIG.9
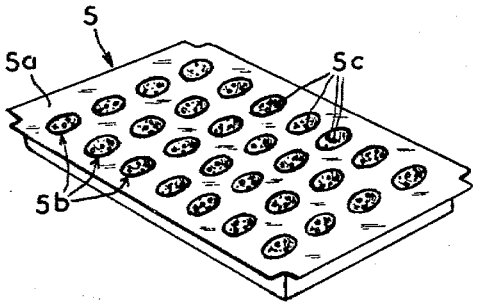
FIG.10
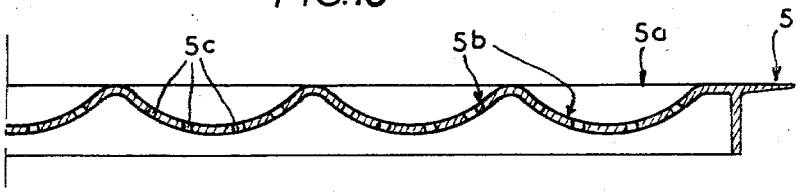

COLLAPSIBLE PLASTIC CRATE FOR DISPLAY AND TRANSPORT OF PERISHABLE COMMODITIES

BRIEF SUMMARY OF THE INVENTION

This invention relates to callapsible plastic crates or boxes for the display and transport of perishable goods.

The object of the invention is to provide a crate or box which can be made from plastic components.

According to the invention, there is provided a collapsible box or case whose sectional components interfit with one another by means of slots, studs and tongues, the sectional components being of latticed or cellular or open mesh work construction ensuring the conveyance, storage or display of the commodities without risk of spoilage, while also providing easy transportation of the lightweight components of the case when delivered flat and its quick, safe assembly without the use of tools.

BRIEF DESCRIPTION OF THE DRAWING

FIG. 5 is a perspective view of a case in accordance with the invention;

FIG. 6 is an exploded view of the separate components of the case according to one variant;

FIG. 7 is a transverse sectional view of a long side element of the variant as shown in FIG. 6;

FIG. 8 is a transverse section view of a short side element of the variant as shown in FIG. 6;

FIG. 9 is a perspective view of a modified version of the bottom of the case; and FIG. 10 is a longitudinal sectional view, on enlarged scale, of the bottom of FIG. 9.

DETAILED DESCRIPTION

As shown in FIGS. 1–4, the case is composed of a bottom member $F_1$, two short side members $F_2$ and two long side members $F_3$. The members $F_1$, $F_2$ and $F_3$ grid-like members of lattice construction.

The bottom member $F_1$ includes a peripheral projection $P_2$ which is inserted in a slot R provided in member $F_2$, such that projection $P_2$ rests on a lower angle member $A_2$ bounding the slot R.

Figure 1:
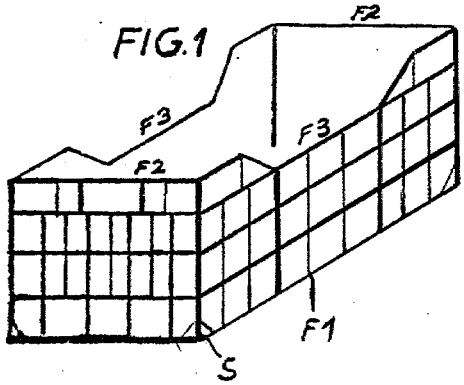
FIG. 1 is a diagrammatic perspective view illustrating one embodiment of the casing according to the invention.
Figure 2:
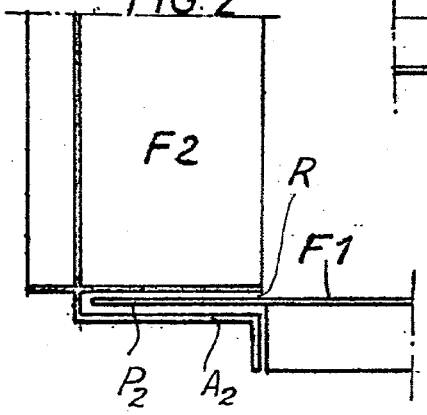
FIGS. 2, 3 and 4 are sectional views respectively taken along lines 2—2, 3—3, and 4—4 in FIG. 5 showing the assembly of the case.
Figure 3:
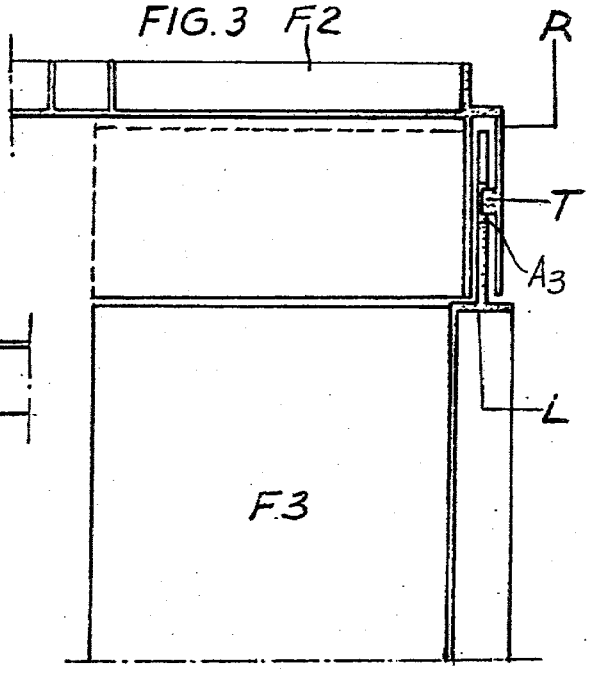
Figure 4:
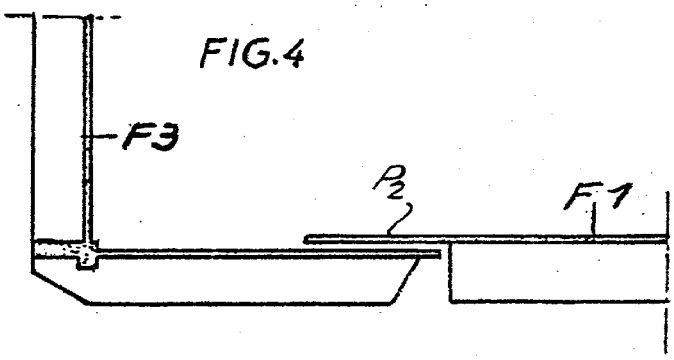

The side members $F_2$ and $F_3$ are interengaged as shown in FIG. 3. Therein, it can be seen that side members $F_2$ are formed with slots R along the side edges facing side members $F_3$, and side members $F_3$ have tongues L entering slots R. The side members $F_2$ are formed with studs T in slots R, and at least some of the tongues L are provided with apertures $A_3$ in which the studs T can be engaged.

The longitudinal and transverse strips of the latticed side members are of T-section or U-section, and for the bottom member of T-section.

The side members and bottom member are reinforced by angle brackets S as shown in FIG. 5.

In assembled state, the vertical corners of the case are composed of three thicknesses of material, viz., two thickness for slot R and one thickness of tongue L, this providing an increased rigidity which assures strength and stability for the entire case.

The members $F_1$, $F_2$, and $F_3$ are flexible, and the slight flexure of the bottom member under the weight of the load in the case tends to apply the side members against the load in the case.

Referring next to FIGS. 6, 7 and 8, therein is shown a case whose member 1 is similar to the member $F_1$ in FIGS. 1–5. The member 1 can also be of a different construction as seen in FIGS. 9 and 10 and as will be described later. In the embodiment shown, the bottom member 1 is composed of a molding with an outer peripheral section 1*a* with a top which forms longitudinal tongues 1*b* and transverse tongues 1*c*. The bottom member 1 is formed with longitudinal strips 1*d* of T section and flat transverse strips 1*e* suitably arranged to give a latticed, unwarpable supporting surface. The bottom member may also be formed of very long strips of U channel section for receiving larger products.

The case has short side members 2 and long side members 3. The short side members 2 are molded with a peripheral rim 2*a* having a slot 2*b* on three sides adapted to receive on the one hand the tongue 1*c* from the bottom member 1 and, on the other hand, a tongue from the long side members 3.

The side members 2 are formed with horizontal strips 2*c* of U-shape cross-section, adjacent strips defining an empty space E therebetween. The strips 2*c* are suitably strengthened, at the middle thereof with upright sections 2*d* of U-shape cross-section.

Above the uppermost strip 2*c*, there are secured vertical strips 2*e* defining an open central space E1 for picking up the case.

The long side members 3 are formed of vertical end strips 3*a*. Longitudinal srips 3*b* are arranged horizontally in vertically spaced relation to define spaces E2 therebetween as seen in FIG. 6. The strips 3*b* are reinforced by vertical strips 3*c* suitably spaced along their length. The strips 3*c* are of U-shape cross-section.

The upper end of side plates 3 can be built up with sections 3*d* permitting a fuller loading of the case.

The end strips 3*a* each carry a tongue 3*e* with notches 3*f* formed in the side edges thereof. The strips 3*a* are also formed with apertures 3*g* for engaging inside studs formed in the slots 2*b* in the side members 2 to ensure safe and non-collapsible assembly.

The U-shaped strip 3*b* located at the bottom of side member 3 forms an angle brace or horizontal tongue 3*h* on which the tongue 1*b* of the bottom member 1 rests on assembly of the case.

Reinforcing brackets can be molded at the bottom corners of the long and short side members 2 and 3 if required.

The thus constructed and assembled case rests with stability on sections or projections 3*i* on the long side members, on a tongue 2*f* of the short side members and on the peripheral section 1*a* of the bottom member 1.

With a base so constructed, it is understandable that some form of intermediate slat is required when small sized products are placed in the box.

When it is desired to display and transport larger products, especially fruit such as peaches, apples, oranges, etc., a bottom member as illustrated at 5 in FIGS. 9 and 10 can be utilized. Therein the strips forming the lattice is replaced by a sheet member 5*a* having a plurality of pockets or cups 5*b* corresponding to the size of the fruit. These pockets can be provided with a number or small-diameter holes 5*c* or slots so as to permit satisfactory ventilation or "breathing" for the product.

In this type of manufacture, the box is generally smaller in height (forming a tray) and receives only one layer of the product. Nevertheless, there may be provided, at various points along the height of the long side members, brackets or slots for supporting a plurality of sheet members *5a* in vertically juxtaposed relation.

In the non-limitative illustrated embodiment, the flat or cupped bottom member is independent from the other members. However, a flat or cupped bottom member can be made integral with two opposite side members. In such case, the same manner of assembly is employed.

Of course the sizes and shapes of the various members forming the box can be arbitrary in number and type, arranged any way, provided they obtain satisfactory rigidity and suitable capacity in the box.

It is to be noted that the horizontal strips 2*c* and 3*b*, and optionally similar strips on the bottom member, are to be sufficiently wide to receive products such as pears, grapefruit, tomatoes, melons, etc., without damage against the sharp edges of the strips during transport.

The members forming the box are obtained by injection molding of a suitable plastic which can be colored in mass.

The case of the invention allows the stacking of at least 10 cases of 15 kilos thus complying with acceptable standards for all dimensions. By way of illustration, the box weighs less than 20 grams per cubic decimeter capacity. The wholly collapsible box can be delivered flat, in contrast with wooden packings customarily used for transporting and displaying perishable goods. The box is lighter than these latter and can be manually assembled without need of a tool. The box is rot-proof, lightweight, compact when dismatled and rapidly assembled, and is usable for shipment of young vegetables, in truck gardening, for shipment of perishable goods, and generally for boxing foodstuffs such as fruit, vegetables, fish, breads, meat, etc. The construction of the box of section members, with flat inner surfaces and a cupped ventilated bottom member allows the shipping, storage and display of delicate products without risk of spoilage.

The case of the invention is not limited in any way as to its mode of application, nor to its method of production and on the contrary, includes all variants obvious to those skilled in the art.

What is claimed is:

1. A collapsible crate for display and transport of perishable commodities comprising, in combination, a plurality of lattice components of molded plastic including a bottom member and held against vertical movement thereof, and long and short side members each composed of strips forming a relatively unwarpable lattice component; and interfitting means connected to said components for assembling the side members of said crate, said bottom member being substantially movable in the plane of said bottom member relative to said side members, said bottom member having projecting tongues; at least two of said side members having ledges supporting respective tongues of said bottom member; the other side members having slots retaining respective tongues of said bottom member and holding said bottom member against vertical movement thereof; said interfitting means comprising a plurality of perforated tongues on one of two adjacent side members to be joined, the other adjacent side member having slots for holding said perforated tongues, said slots having projecting locking elements, said locking elements extending into the perforations of said perforated tongues for locking together said adjacent members.

2. A crate as claimed in claim 1, wherein the strips of the bottom and side members have flat inner faces against which the commodities to be carried and displayed are engaged.

3. A crate as claimed in claim 2, wherein the strips of the side members are arranged horizontally with an open space between adjacent strips.

4. A crate as claimed in claim 3, wherein said strips are of U-shape cross-section with a base having a sufficient width to permit holding large fruit products without minimum risk of damage by the corners of the strips.

5. A crate as claimed in claim 2, wherein the bottom member includes flat strip sections.

6. A crate as claimed in claim 2, wherein said bottom member comprises a sheet member having a plurality of pockets for receiving products of corresponding size, each pocket having at least one ventilation orifice.

7. A crate as claimed in claim 6, wherein the side wall members are relatively low in height and form a tray with a single loading level.

8. A crate as claimed in claim 2, wherein said bottom member is separable from the side members and includes a peripheral tongue which rests on the side wall members.

9. A crate as claimed in claim 2, wherein said interfitting means comprises tongues on one of the side wall members and slots in the other of the side wall members for receiving said tongues, said bottom member including a peripheral tongue, the side wall members having support surfaces for the tongue on the bottom member.

10. A crate as claimed in claim 9, wherein the side wall members include integral studs in said slots, said tongues having apertures for engaging the studs when the tongues are inserted into the slots.

* * * * *